US005163514A

United States Patent [19]

Jennings

[11] Patent Number: 5,163,514

[45] Date of Patent: Nov. 17, 1992

[54] BLOWOUT PREVENTER ISOLATION TEST TOOL

[75] Inventor: Charles E. Jennings, Houston, Tex.

[73] Assignee: ABB Vetco Gray Inc., Houston, Tex.

[21] Appl. No.: 743,640

[22] Filed: Aug. 12, 1991

[51] Int. Cl.[5] ..... E21B 33/00

[52] U.S. Cl. ..... 166/368; 166/348; 166/206

[58] Field of Search ..... 166/368, 338-342, 166/381-383, 386, 387, 206-208, 348

[56] References Cited

U.S. PATENT DOCUMENTS 4,742,874 5/1988 Gullion ..... 166/348
4,969,516 11/1990 Henderson et al. ..... 166/368 X
4,978,147 12/1990 Henderson et al. ..... 166/368 X

*Primary Examiner*—Thuy M. Bui
*Attorney, Agent, or Firm*—James E. Bradley

[57] ABSTRACT

A well tool locates within a subsea wellhead to seal and isolate the wellhead from testing of blowout preventer stack located on a riser string extending from the wellhead to a surface vessel. The well tool has a mandrel and a body which are axially moveable relative to each other. The body has a locking element which can move from a radially retracted position outward to engage grooves in the wellhead. The body also has an elastomeric seal for sealing the interior of the wellhead. A wedge ring has a compression member mounted to it for energizing the seal. Simultaneously, the wedge ring pushes the dogs outward. The wedge ring moves downward with the mandrel. A retaining assembly will retain the mandrel in the upper position until it is desired to set the tool. The retainer releases the mandrel for moving downward by rotating less than one turn. The wedging surfaces can be moved to a disengaging position to disengage the wedging surfaces from actuating the locking element. A second embodiment allows the isolation tool to also be utilized as a running tool.

19 Claims, 7 Drawing Sheets

BLOWOUT PREVENTER ISOLATION TEST TOOL

BACKGROUND OF THE INVENTION

1. Field of the Invention

This invention relates in general to subsea well tools, and in particular to a tool that will seal in the bore of a wellhead for testing a blowout preventer located above.

2. Description of the Prior Art

In one type of offshore drilling, a subsea wellhead will be installed at the sea floor. A riser will connect to the wellhead and extend upward to a drilling vessel floating at the surface. A blowout preventer stack will be located within the riser.

It is a good practice to test a blowout preventer by closing the blowout preventer on drill pipe and applying pressure below the drill pipe. This test also tests the seal of the wellhead connector to the subsea wellhead housing. In order to perform this test, the wellhead housing bore needs to be sealed so that the pressure will be applied only from the wellhead housing upward. While test tools are available, improvements are desired.

For example, it would be an advantage to utilize a test tool which locks into internal grooves provided in the wellhead to react against the pressure imposed by the test pressure tending to push the test tool downward. Moreover, it would be desirable to have a test tool that optionally can test without locking into the wellhead grooves within a portion that below the grooves. In that case, the reaction force could be handled by landing the test tool on a casing hanger. Furthermore, it would be desirable to have a test tool which is also capable of being modified for running the wellhead rather than have a completely separate tool for running the wellhead and a separate tool for testing.

SUMMARY OF THE INVENTION

The well tool of this invention has a mandrel which connects to a string of conduit that will be lowered from the vessel. A body is carried by the mandrel for insertion into the bore of the wellhead. The mandrel is movable relative to the body between an upper position and a lower position. A locking element is carried by the body for movement radially between a retracted position and a locked position in supporting engagement with grooves in the wellhead.

An annular seal is also carried by the body for engaging the inner wall of the wellhead. A compression member is mounted above the seal and carried by the mandrel for movement with the mandrel. When the mandrel moves to the lower position, the mandrel will push downward on the compression member to cause the seal to set. Simultaneously, a cam carried by the mandrel for movement with the mandrel will push the locking element from the retracted position to the locked position.

The well tool also has a retaining means which will retain the mandrel in the upper position until the locking member locates adjacent a desired point in the wellhead. Rotating the conduit at that point causes rotation of the mandrel relative to the wellhead, releasing the retaining means and allowing the mandrel to drop downward.

Additionally, a selector will allow the operator to select to either utilize the locking member or to deactivate the locking member. The selection process includes rotating the wedge ring relative to the body for a selected circumferential distance, then locking it in place. In the engaging position, the wedge ring will wedge locking dogs outward. In the deactivated position, slots formed on the wedge ring align with the locking dogs, preventing the wedge ring from moving the dogs outward as the wedge ring moves downward.

In an alternate embodiment, the retaining means will also allow tension to be placed in the wellhead by the tool. The alternate embodiment tool can be used as a test tool in a similar manner. Alternately, it can be used to run the wellhead. In this embodiment, an upward load will transmit from the mandrel, through the body, through the locking member, and to the mandrel. This embodiment utilizes a pair of ring segments carried in mating recesses located between the body and the mandrel. A pair of balls locate between the ends of the semi-circular ring segments. Rotating the mandrel will cause the balls to push the ring segments outward from one recess into the other. This allows the mandrel to drop downward. As the mandrel drops downward, the ring segments will ratchet into load grooves provided on the mandrel.

DESCRIPTION OF THE PREFERRED EMBODIMENT

Figure 1:
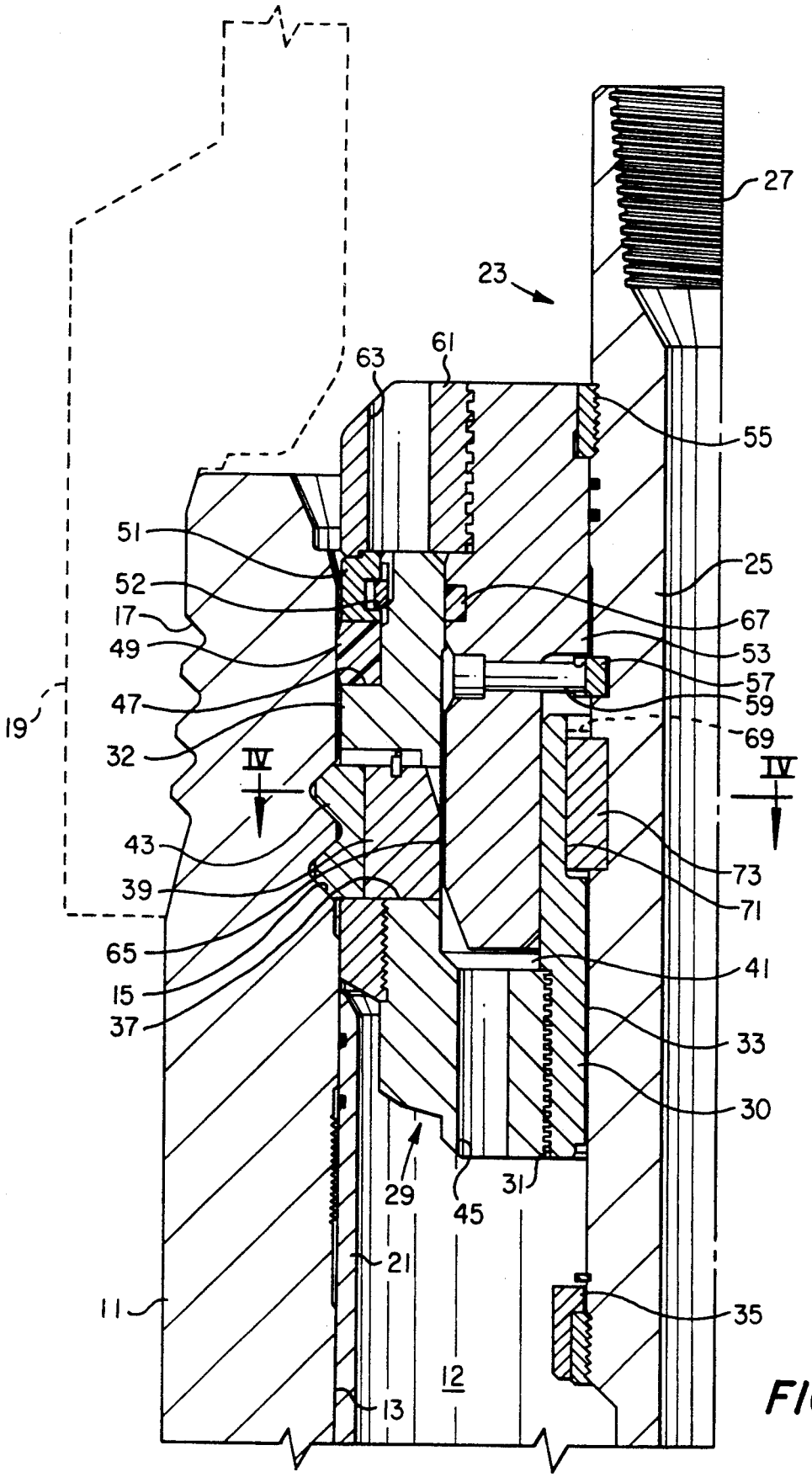
FIG. 1 is a quarter sectional view illustrating a well tool constructed in accordance with this invention, and showing the well tool in a sealed and locked position to the wellhead for testing.

Referring to FIG. 1, wellhead 11 is a cylindrical tubular member that will be supported on a sea floor. Wellhead 11 has an axial bore 12 defining a cylindrical inner wall 13. A pair of interior grooves 15 locate in the inner wall 13. Grooves 15 are perpendicular to the longitudinal axis of wellhead 11 and parallel to each other.

A set of exterior grooves 17 locate on the exterior of wellhead 11. Exterior grooves 17 are perpendicular to the longitudinal axis of wellhead 11 and parallel to each other. A conventional wellhead connector 19, shown by dotted lines, will be lowered on a string of riser (not shown) from a drilling vessel at the surface. Wellhead connector 19 will latch into the exterior grooves 17. A seal (not shown) will seal the connection between the wellhead connector 19 and the wellhead 11. FIG. 1 shows a bore protector 21 located within the inner cylindrical wall 13. Bore protector 21 is a removable sleeve that locates in wellhead 11 during drilling operations to protect surfaces in inner cylindrical wall 13 that are later used for sealing.

An isolation tool 23 is shown lowered and latched into wellhead 11 in FIG. 1. Isolation tool 23 will seal bore 12 of wellhead 11. This allows pressure to be applied below a blowout preventer stack (not shown), which is a part of the riser extending upward from wellhead connector 19. The isolation tool 23 will isolate the test pressure in the wellhead connector 19 from pressure in the wellhead 11 below the isolation tool 23.

Isolation tool 23 includes an axial mandrel 25. Mandrel 25 has threads on its upper end. A conduit, normally drill pipe, will secure to threads 27 to lower the isolation tool 23 into wellhead 11. Isolation tool 23 also has a body 29. Body 29 is a tubular member that is carried by mandrel 25. Body 29 has an inner body portion 30 and an outer portion 32, which is connected to the inner body portion 30 by threads 31. A central axial passage 33 extends through body 29 in its inner portion 30. Mandrel 25 closely and slidingly fits within the body passage 33.

Figure 6:
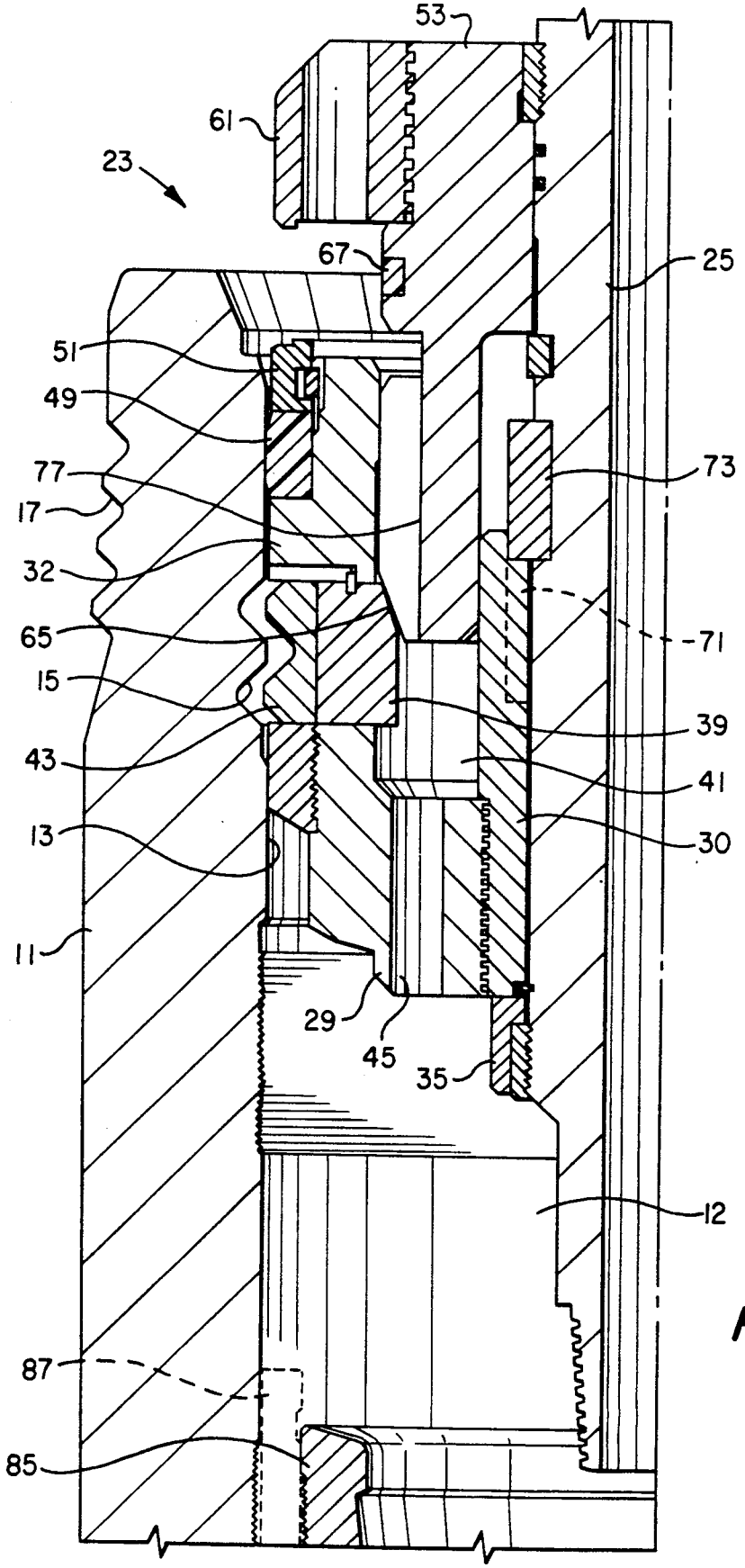
FIG. 6 is a quarter sectional view of the well tool of FIG. 1, taken along a different section from that of FIG. 1, and showing the wedge ring of the well tool in the deactivated position in which the dogs will not engage the wellhead.

A retaining ring 35 secures to mandrel 25 below body 29. Retaining ring 35 will support the weight of body 29 when the isolation tool 23 is being lowered into and pulled from the wellhead 11. Mandrel 25 is able to move between an upward position shown in FIGS. 2 and 6 and a lower position shown in FIG. 1. In the upper position, as shown in FIG. 6, the body 29 is supported on retaining ring 35.

Figure 4:
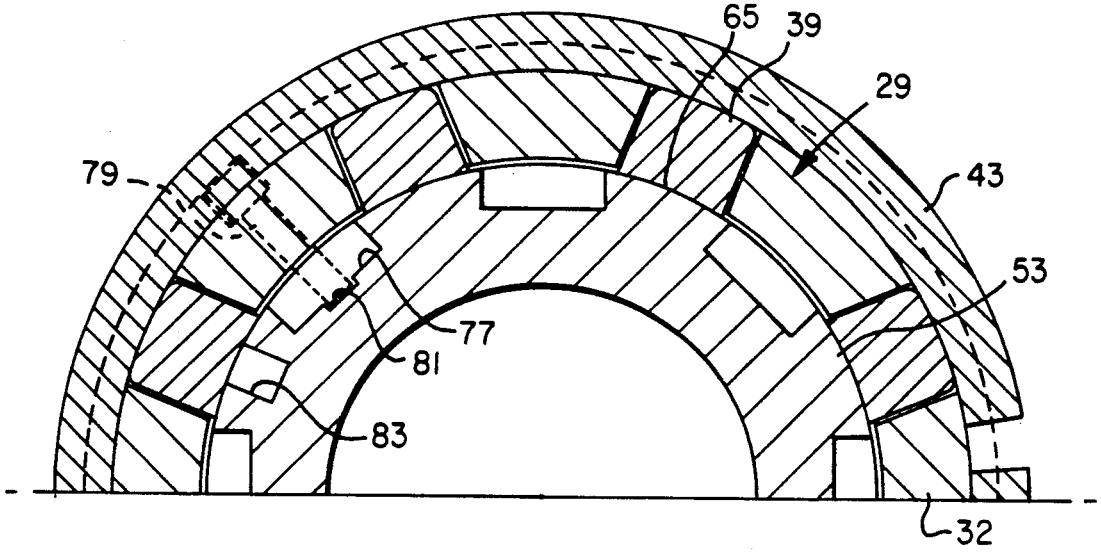
FIG. 4 is a cross sectional view of the well tool of FIG. 1, taken along the lines IV—IV of FIG. 1, showing the dogs in an engaged, locked position.

Referring again to FIG. 1, body 29 has a plurality of apertures 37 in its outer portion 32. Apertures 37 are spaced apart from each other and extend circumferentially around body 29. A locking dog 39 is carried in each aperture 37. Dogs 39 will move redially between an engaged position, as shown in FIG. 1 and 4, and a retracted position, shown in FIG. 2. In the retracted position, dogs 39 will extend radially inward into a body cavity 41. Cavity 41 is an annular space located between the inner portion 30 and the outer portion 32 of body 29. A split ring 43 locates on the exterior of the dogs 39. Split ring 43 is a resilient metal ring that expands outward and contracts with the dogs 39. Split ring 43 has a grooved profile on its exterior that mates with the wellhead interior grooves 15 to lock the isolation tool 23 to wellhead 11.

Figure 2:
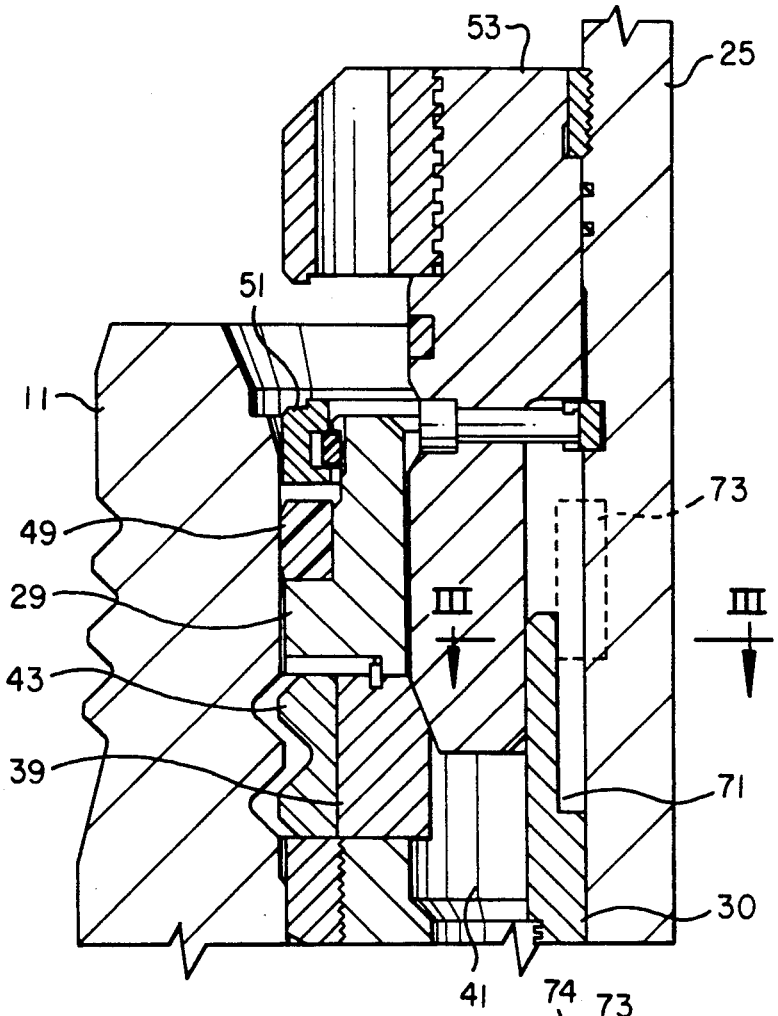
FIG. 2 is a partial quarter sectional view of the well tool as shown in FIG. 1, but showing the well tool in an upper released position being lowered into the wellhead.

Body 29 has a plurality of flow passages 45 that extend from the lower end into the cavity 41. Flow passages 45 are circumferentially spaced apart from each other and parallel to the central axial passage 33. The outer portion 32 of body 29 has an upward facing seal shoulder 47 on its exterior. A seal 49 locates on seal shoulder 47. Seal 49 is a large elastomeric seal for sealing against the inner cylindrical wall 13 of wellhead 11. Seal 49 is an assembly that includes with it a metal compression ring 51 located directly above. Compression ring 51 is retained with body outer portion 32 by means of a retaining ring 52. Retaining ring 52 is free to move a certain distance axially within a recess provided in body outer portion 32. This allows the compression ring 51 to move between an upper position, as shown in FIG. 2, wherein it protrudes above the body outer portion 32, to a lower compressed position as shown in FIG. 1.

A wedge ring 53 secures to mandrel 25 for axial movement therewith. Wedge ring 53 thus moves axially relative to body 29, as can be seen by comparing FIG. 1 with FIGS. 2 and 3. Wedge ring 53 secures to mandrel 25 by means for a pair of semi-circular ring segments 55 for transmitting axial load. In addition, a retaining ring 57 locates within mating grooves in mandrel 25 and wedge ring 53. A number of threaded screws or pins 59 extend through wedge ring 53 and compress a split ring 55. Load is also transmitted through split ring 55.

Compression ring 61 secures by threads to the wedge ring 53. Compression ring 61 has a lower surface that engages the compression ring 51. The upper portion of wedge ring 53 and compression ring 61 make up a compression member carried by mandrel 25 for applying compression to seal 49 to cause it to sealingly engage inner cylindrical wall 13. A plurality of flow passages 63 extend through compression ring 61.

Wedge ring 53 has cam means for moving the dogs 39 from the retracted position to the engaged position. The cam means comprises a wedge surface 65 formed on a lower portion of wedge ring 53. The wedge surface 65 is a cylindrical surface that comes into engagement with the dogs 39 when the wedge ring 53 is moved from the upper position shown in FIG. 2 to the lower position shown in FIG. 1. The wedge ring 53 thus simultaneously moves the dogs 39 to the engaged position and compresses the seal 49. A seal 67 on the exterior of wedge ring 53 engages an interior wall of outer body portion 32. Seal 67 seals the body cavity 41 when wedge ring 53 is in the lower position. Flow is blocked through passages 45 while in this position. 41 when wedge ring 53 is in the lower position. Flow is blocked through passages 45 while in this position.

Figure 3:
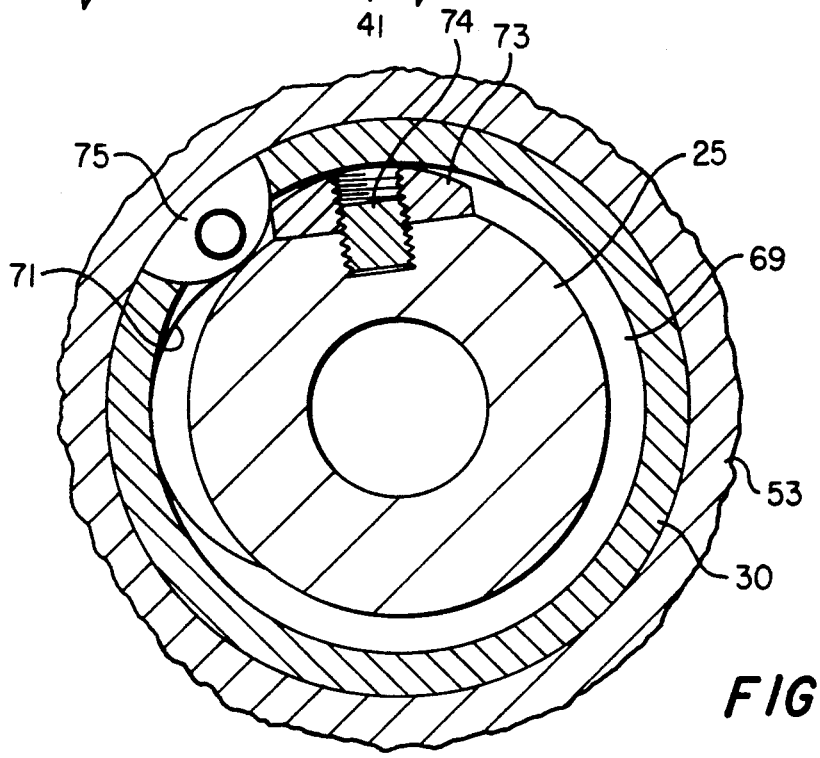
FIG. 3 is a quarter sectional view of the well tool of FIG. 1, taken along the line III—III of FIG. 2.

A retaining means will retain the mandrel 25 and wedge ring 53 in the upper position until the operator has lowered the isolation tool 23 to the desired point in wellhead 11. The retaining means in the embodiment of FIGS. 1–6 includes a shoulder 69, shown in FIG. 1 by dotted lines, and illustrated by solid lines in FIG. 3. Shoulder 69 is upward facing and located in body inner portion 30 near its upper end. The inner diameter of shoulder 69 joins the body passage 33. A pocket 71 extends downward from shoulder 69. As shown in FIG. 3, a pocket 71 is an axial slot in the body inner portion 30. Pocket 71 is arcuate when viewed above, shown in FIG. 3.

A key 73 is dimensioned to fit slidingly in pocket 71. Key 73 is secured to the exterior of mandrel 25 by a screw 74 (FIG. 3). Key 73 thus will rotate and move axially with mandrel 25. Key 73 has an axial length that is about the depth of the pocket 71. In the position shown in FIGS. 2, 3 and 6, key 73 is spaced above shoulder 69. If the body 29 is supported on bore protector 21 (FIG. 1), key 73 will rest on shoulder 69 and hold the mandrel 25 in the upper position. If mandrel 25 is rotated less than one turn to the right, looking down as shown in FIG. 3, key 73 will move around shoulder 69 and will be in a position to drop into pocket 71. Lowering the drill pipe once key 73 is aligned with pocket 71 will cause key 73 to drop into pocket 71, as shown in FIG. 1. Mandrel 25 will drop to the lower position as key 73 drops into pocket 71.

A stop 75, secured to the upper end of body inner portion 30, will prevent the key 73 from rotating more than one revolution. Key 73 will contact stop 75 at the point where it is aligned for axially dropping into pocket 71. Key 73, pocket 71, shoulder 69 and stop 75 serve as retaining means for retaining the mandrel 25 in the upper position, and at the appropriate point, allowing the mandrel 25 to be dropped to the lower position.

Referring now to FIG. 4, and also FIG. 6, a selector means exists for selectively utilizing dogs 39 or deactivating dogs 39. In the position shown in FIG. 1, dogs 39 engage the wellhead 11 for reacting against the downward load due to the test pressure being applied above isolation tool 23. In some cases, it may not be possible or desirable to lock the dogs 39 into wellhead 11. It may be desirable to set the seal 49 at a point below the wellhead interior grooves 15. As shown in FIG. 4, the selector means includes a plurality of slots 77 spaced circumferentially around wedge ring 53. The wedge surfaces 65 are spaced between the slots 77. In FIG. 4, the wedge surfaces 65 are shown engaging the dogs 39 and pushing them outward into an engaged position. A pin 79 extends through a hole in body outer portion 32 and into a hole 81 in one of the slots 77 to lock the wedge ring 53 in the engaging position shown in FIG. 4.

Figure 5:
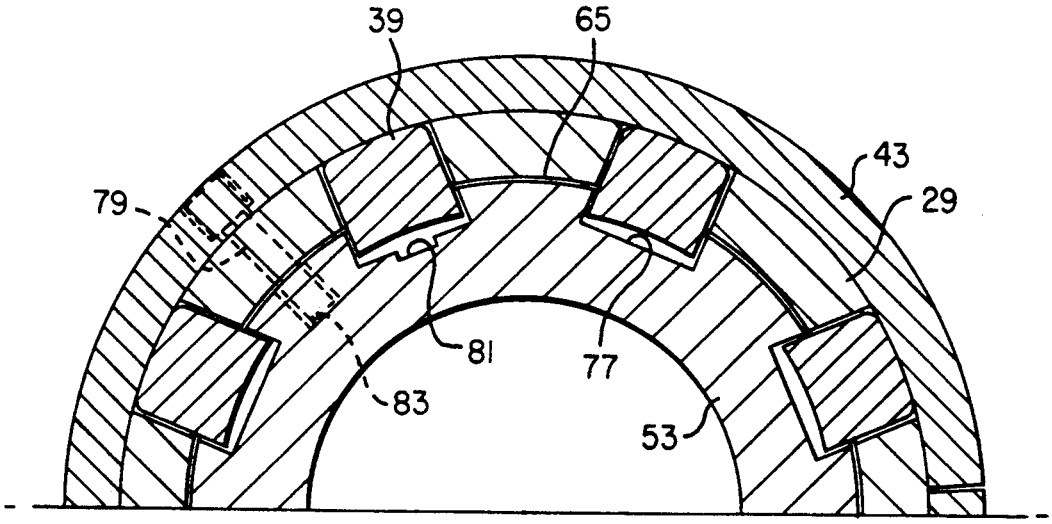
FIG. 5 is a cross sectional view similar to FIG. 4, but showing the wedge ring of the well tool rotated to a deactivated position in which the locking dogs do not engage the wellhead.

By removing pin 79 and rotating wedge ring 53 relative to body outer portion 32, the slots 77 can be positioned to align with the dogs 39. This deactivating position is shown in FIG. 5. Each slot 77 has a width that closely receives one of the dogs 39. Each slot 77 extends axially along the exterior of the wedge ring 53, as shown in FIG. 6. In the deactivated position, pin 79 will be secured into a hole 83 in wedge ring 53 to prevent further rotation. In the deactivated position, downward movement of the wedge ring 53 relative to the body 29 and dogs 39 will not move the dogs 39 outward.

The changing of the positions from the engaging position shown in FIG. 4 to the deactivated position shown in FIG. 5 would be done at the surface prior to lowering the isolation tool 23 into wellhead 11. FIG. 6 illustrates the isolation tool 23 being lowered into wellhead 11 with the wedge ring 53 in the deactivated position and the mandrel in the upper position. In FIG. 4, the bore protector 21 has been removed and a casing string has been run. A casing hanger 85 will be installed in wellhead 11 during running of the casing string and sealed by a seal 87, shown by dotted lines. In this instance, the isolation tool 23 may land on the casing hanger 85, rather than bore protector 21. Once landed, the dogs 39 will be spaced a considerable distance below the interior grooves 15.

In the operation of the embodiment illustrated in FIGS. 1–4, the operator will connect the isolation tool 23 to a string of drill pipe (not shown) by means of the threads 27. The mandrel 25 and wedge ring 53 will be retained in an upper position illustrated in FIG. 2, as the isolation tool 23 is lowered through riser and into wellhead 11. The key 73 will be located above shoulder 69 in the running position. While being lowered, fluid in the riser can flow through the flow passages 45, through body cavity 41, and through slots 77 (FIG. 4).

The isolation tool 23 will land on the bore protector 21. At this point, the profile of the split ring 43 will be substantially aligned with the wellhead interior grooves 15. Once in contact with the bore protector 21, continued downward movement would tend to cause mandrel 25 to move downward relative to body 29. Key 73 will engage shoulder 69 to prevent downward movement of the mandrel 25 relative to the body 29. The operator will rotate the drill pipe to the right for slightly less than one turn. The weight on the body 29 contacting the bore protector 21 will prevent the body 29 from rotating. The mandrel 25 will thus rotate relative to body 29. The key 73 will move around, contact stop 75 (FIG. 3) and drop into pocket 71.

As key 73 drops into pocket 71, mandrel 25 will move downward. The compression ring 61 will contact the compression ring 51 to deform seal 49 out into engagement with wellhead inner cylindrical wall 13. As wedge ring 53 moves downward with mandrel 25, seal 67 will slidingly engage the inner wall of body outer portion 32. This blocks the flow passages 45 and blocks flow through the slots 77 (FIG. 4). Simultaneously, the wedging surfaces 65 will push the dogs 39 outward. The dogs 39 push the split ring 43 outward to engage the interior grooves 15. As the split ring 43 enters the grooves 15, the body 29 will raise up slightly, removing it from supporting contact with the bore protector 21.

In this position, seals 67 and 49 will isolate the bore 12 of wellhead 11 from the riser above. The operator may close the blowout preventor (not shown) around the drill pipe (not shown). Pressure will be applied to the annulus surrounding the drill pipe and mandrel 27. This exerts a downward force on the isolation tool 23. The split ring 43 will react against this force, transmitting the load to wellhead 11. The pressure above isolation tool 23 will be isolated from being applied below isolation tool 23.

When the test is completed, the operator simply picks up the drill pipe. The mandrel 25 will move upward, bringing along with it the wedge ring 53. The flow passages 45 will now again be open for equilization of pressure from above the isolation tool 23 to below. The seal 49 will be de-energized by upward movement of the compression rings 51 and 61. The operator will retrieve the isolation tool 23 to the surface.

If one wishes to utilize the isolation test tool in the configuration shown in FIGS. 5 and 6, the operator would remove pin 79 and rotate the wedge ring 53 relative to the body outer portion 32 a short distance prior to running the isolation tool 23. In the position shown in FIG. 5, the operator then inserts the pin 79 into hole 83. The operator then runs the isolation tool 23 in the same manner as described above, except that the dogs 39 will be deactivated. The operator may land the isolation tool 23 on casing hanger 85 in this instance. When moving to the lower position, the wedge ring 53 will not push the dogs 39 outward because of the alignment of the slots 77 with the dogs 39. Dogs 39 thus remain in the disengaged position. The compression ring 61 will energize the seal 49 once the wedge ring 53 reaches the lower position. The downward load on the isolation tool 23 due to the pressure test is taken by the casing hanger 85, which transmits the load to the wellhead 11.

Figure 7:
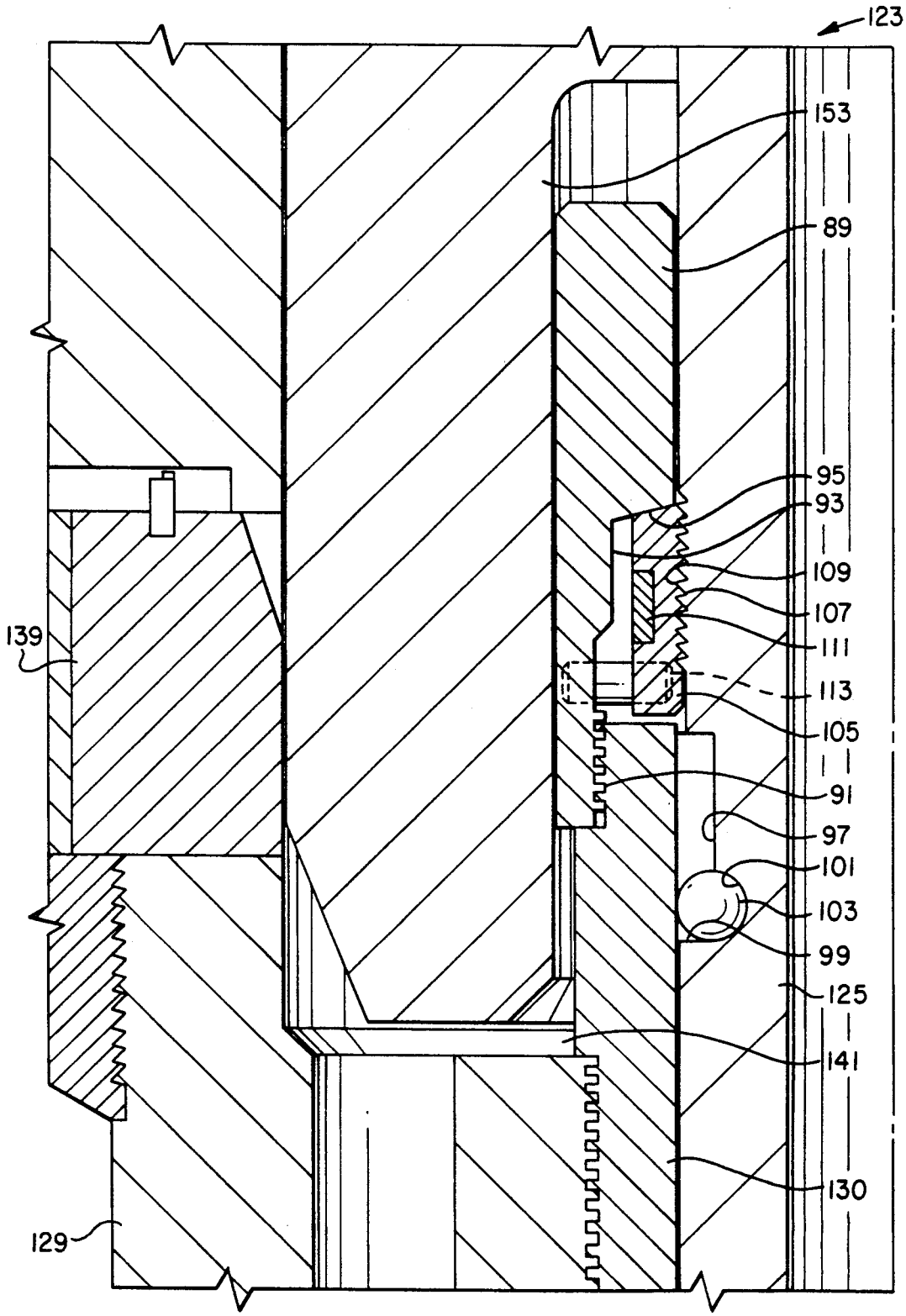
FIG. 7 is an enlarged quarter sectional view of a portion of an alternate embodiment of a well tool constructed in accordance with this invention, and showing the well tool in a locked position for supporting the weight of the wellhead.
Figure 8:
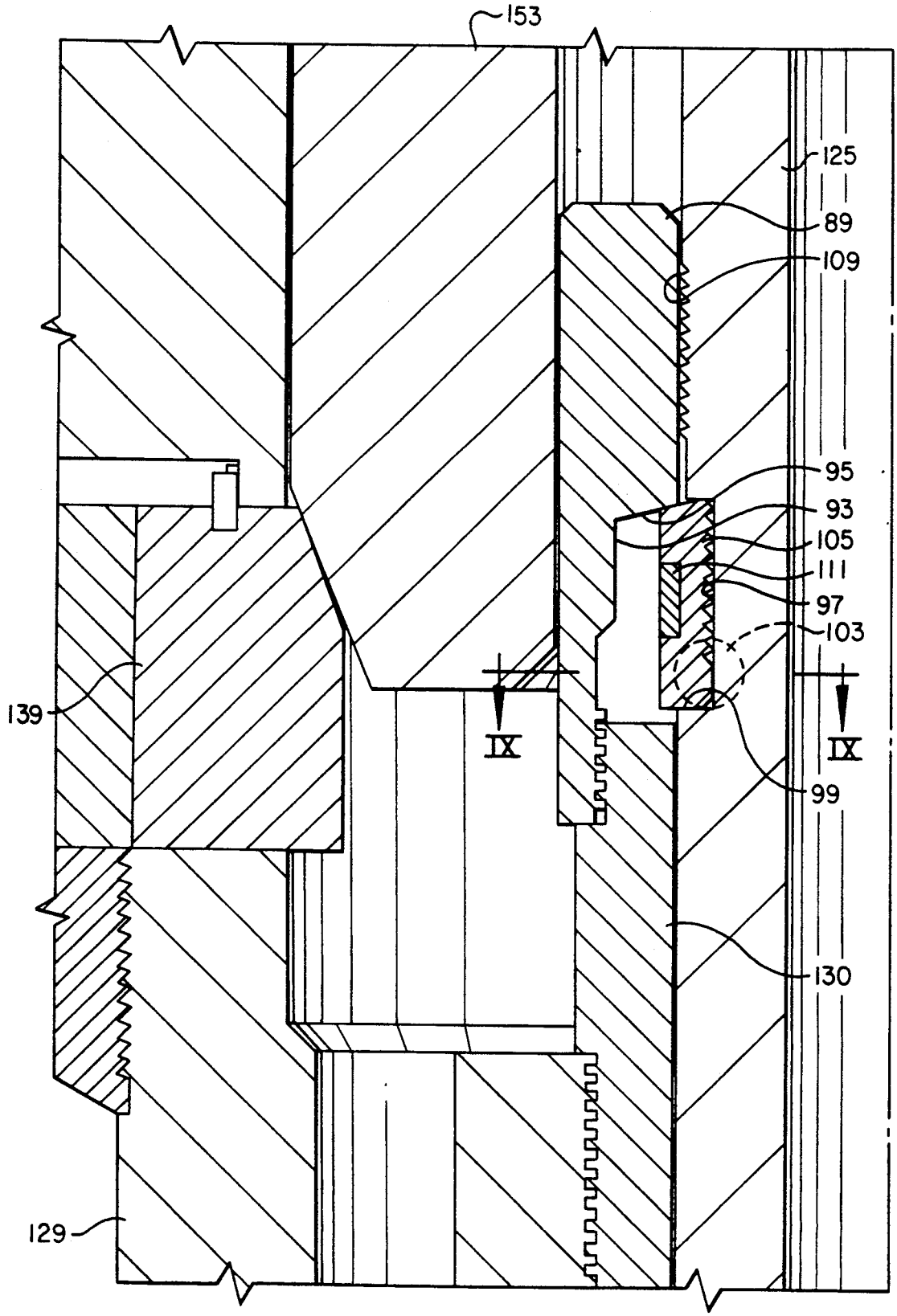
FIG. 8 is an enlarged quarter sectional view of the well tool shown in FIG. 7, taken along a different sectional line, and showing the mandrel and housing in an unlocked position relative to each other.
Figure 9:
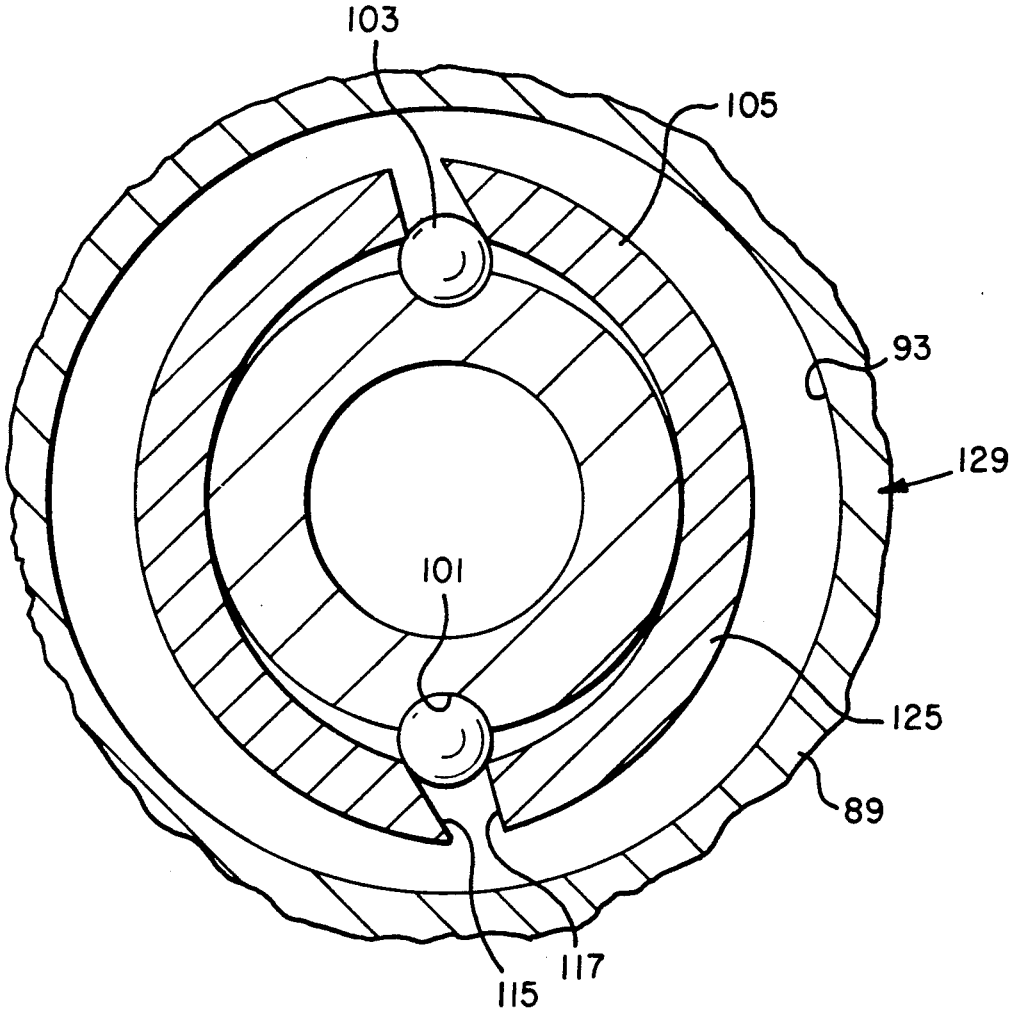
FIG. 9 is a sectional view of the well tool of FIG. 7, taken along the line IX—IX of FIG. 8.

In the alternate embodiment of FIGS. 7, 8 and 9, elements which are substantially the same as in the embodiment of FIGS. 1–6 are indicated with the same numeral, except for the addition of a "1". In the second embodiment, a different means is shown for retaining the mandrel 125 and wedge ring 153 in the upper position. The retaining means in the second embodiment differs in that it will allow an upward pull to be exerted on wellhead 11. Consequently, the tool can be used to run the wellhead 11 into place as well used for testing.

In this embodiment, body 129 has an inner portion 130. The inner portion 130 is in two pieces, having an upper section 89 connected by threads 91. A body recess 93 locates in the upper section 89. Mandrel 125 has a mating mandrel recess 97. When mandrel 125 is in the upper position, as illustrated in FIG. 8, the recesses 93, 97 will be aligned with each other to define a cavity. In FIG. 7, mandrel recess 97 is shown spaced below body recess 93 because of downward movement of mandrel 125 relative to body 129. Mandrel recess 97 has an upward facing shoulder 99 on its lower end.

Two semi-spherical pockets 101 are machined into the lower portion of mandrel recess 97. As shown in FIG. 9, pockets 101 are located 180 degrees apart from each other. Pockets 101 are located at the upward facing shoulder 99. A ball 103 locates within each pocket 101. About half of each ball 103 will protrude outward into recess 97, with the remaining half located in pocket 101.

A pair of semi-circular ring segments 105 are carried in body recess 93. When mandrel 125 is in the upper position, as shown in FIG. 8, ring segments 105 will protrude radially inward into mandrel recess 97. The weight of body 129 transmits from shoulder 95 through ring segments 105 and retains the mandrel 125 in the upper position relative to body 129.

The ring segments 105 each have a grooved interior profile 107. The grooves 107 of each ring segment 105 align with each other to define a set of helical threads. The grooved profiles 107 mate with a circumferential set of left-hand threads or load shoulders 109 formed on the exterior of mandrel 125. In the position shown in FIG. 7, upward pull on mandrel 125 transmits through threads 109 and 107, through the ring segments 105 and shoulder 95 into body 129.

A bias ring 111 encircles the exterior of the ring segments 105. Bias ring 111 is a metal split ring which urges the ring segments 105 to contract around the mandrel 125. An anti rotation pin 113 prevents rotation of the ring segments 105 relative to the body 129.

When the mandrel 125 is in the upper position as shown in FIG. 8, the balls 103 will locate between ends 115 and 117 of the ring segments 105, as shown in FIG. 9. Ends 115 are tapered, while ends 117 are on a radial line. Right hand rotation of mandrel 125 relative to body 29 and ring segments 105 will cause the balls 103 to push the ring segments 105 radially outward. The balls push the ring segments 105 completely out of engagement with the mandrel recess 97, enabling mandrel 125 to drop downward. The groove profiles 107 will ratchet into the threads 109.

In the operation of the embodiment of FIGS. 7-9, if it is desired to run a wellhead 11 (FIG. 1), then the tool 123 will be inserted into wellhead 11 while tool 123 is in the position shown in FIG. 8. This would be done at the surface. Normally, large diameter conductor pipe would be secured to the lower end of the wellhead 11. When the dogs 139 are properly positioned for engaging wellhead interior grooves 15 (FIG. 1), the operator will rotate mandrel 125 to the right while holding body 129. The balls 103 will push the ring segments 105 out from mandrel recess 97. The mandrel 125 will drop downward. The ring segments 105 will ratchet into and engage the threads 109.

At the same time, the wedge ring 153 moves downward, pushing the dogs 139 out to engage the wellhead interior grooves 15 (FIG. 1). A seal, such as seal 49 (FIG. 1), may be utilized also to seal against the interior of wellhead 11. While being lowered, the upward pull on mandrel 125 due to the weight of the wellhead 11 and conductor pipe attached thereto transmits through threads 109 and ring segments 105 into shoulder 95. This load transmits through dogs 139 from the wellhead 11 (FIG. 1). This is the position shown in FIG. 7. The operator can then proceed to lower the wellhead into the sea for positioning. If a seal such as seal 49 (FIG. 1) is used, displaced fluid would flow through the interior of mandrel 25 as the assembly is lowered.

To release the tool 123 from wellhead 11, the operator rotates again to the right. This rotation will unscrew the left-hand threads 109 from the ring segments 105. The operator then picks up. The bias ring 111 will cause the ring segments 105 to contract inward to the position shown in FIG. 8. The operator then will lift the mandrel 125 for bringing along with it the body 129. The wedge ring 153 moves upward with mandrel 125 to allow the dogs 139 to retract.

Subseqently, after connection of riser and a blowout preventer stack, the same tool 123 could be used to pressure test the blowout preventer. It would operate in the same manner, except it would be lowered into the wellhead while in the position shown in FIG. 8. The operator would rotate the drill string once the tool 123 has landed to energize a seal 49 (FIG. 1) and engage the dogs 139 with the wellhead 11. In that case, after testing, the operator would release by rotating and picking up the drill string.

Also, the operator could readily convert the running tool 123 of the second embodiment to the first embodiment isolation tool 23 for testing by replacing mandrel 125, inner body portions 130, 89 and ring segments 105 with mandrel 25, inner body 130, and key 73. The remaining portions of the assemblies could be interchangeable.

The invention has significant advantages. The invention allows an isolation tool to be lowered into a wellhead and set to isolate the wellhead from a pressure test above the wellhead. The isolation tool can rely on locking dogs to take the reaction load. Alternately, the load can be transmitted to a wellhead structure, such as an installed casing hanger. In an alternate embodiment, the tool can be used additionally to run a wellhead.

While the invention has been shown in only two of its forms, it should be apparent to those skilled in the art that it is not so limited, but is susceptible to various changes without departing from the scope of the invention.

I claim:

1. A well tool for connection to a subsea wellhead having a bore defining an inner wall, comprising in combination:

a mandrel adapted to be connected to a string of conduit;

a body carried by the mandrel for insertion into the bore of the wellhead, the mandrel being movable relative to the body between an upper position and a lower position;

a locking element carried by the body for selective radial movement between a retracted position and a locked position in supporting engagement with the inner wall of the wellhead;

an annular seal carried by the body for engaging the inner wall of the wellhead;

a compression member mounted above the seal and carried by the mandrel for movement therewith, the compression member being moved downward by the mandrel into energizing engagement with the seal when the mandrel moves to the lower position, forcing the seal into sealing engagement with the inner wall of the wellhead; and cam means carried by the mandrel for movement therewith for selectively moving the locking element from the retracted position to the locked position as the mandrel moves downward relative to the body to the lower position.

2. The well tool according to claim 1 further comprising retaining means for retaining the mandrel in the upper position until the locking member locates adjacent a selected point in the wellhead.

3. The well tool according to claim 1 further comprising retaining means for retaining the mandrel in the upper position and for allowing the mandrel to move to the lower position by rotating the mandrel relative to the body.

4. The well tool according to claim 1 further comprising means for selectively preventing the cam means from moving the locking member to the locked position as the mandrel moves downward relative to the body, allowing the compression member to energize the seal without the locking member being in the locked position.

5. A well tool for engaging a subsea wellhead having a bore defining a cylindrical inner wall which has an annular groove, comprising in combination:

a mandrel adapted to be connected to a string of conduit;

a body carried by the mandrel for insertion into the bore of the wellhead;

means for allowing the mandrel to move relative to the body between an upper position and a lower position;

a locking element carried by the body for selective radial movement between a retracted position and a locked position in locking engagement with the groove in the wellhead;

an annular seal carried by the body above the locking element for engaging the inner wall of the wellhead;

a compression member mounted above the seal and carried by the mandrel for movement therewith, the compression member moving downward with the mandrel into energizing engagement with the seal when the mandrel moves to the lower position, forcing the seal into sealing engagement with the inner wall of the wellhead;

cam means carried by the mandrel for movement therewith for selectively moving the locking element from the retracted position to the locked position simulaneously with the energizing engagement of the compression member with the seal as the mandrel moves downward relative to the body to the lower position; and retaining means for retaining the mandrel in the upper position and for allowing the mandrel to move to the lower position by rotating the mandrel relative to the body.

6. The well tool according to claim 5 wherein the body has a passage through which the mandrel passes and wherein the retaining means comprises:

an annular upward facing shoulder formed in the passage in the body;

an axially extending pocket located in the body and extending downward from the shoulder; and a key secured to the mandrel for movement therewith, the key landing on the shoulder while the mandrel is in the upper position, thereby supporting the mandrel in the upper position, and wherein rotating the mandrel relative to the body will align the key with the pocket, allowing the key to drop into the pocket and allowing the mandrel to move downward to the lower position.

7. The well tool according to claim 5 wherein the body has a passage through which the mandrel passes and wherein the retaining means comprises:

an annular body recess located within the passage of the body;

an annular mandrel recess located on the exterior of the mandrel, the body recess and the mandrel recess being aligned with the body recess when the mandrel is in the upper position and being spaced below the body recess when the mandrel is in the lower position;

a load groove formed on the mandrel above the mandrel recess;

a pair of semi-circular ring segments carried in the body recess and protruding radially inward into the mandrel recess when the mandrel is in the upper position to selectively prevent axial movement of the mandrel relative to the body, each of the ring segments having a pair of ends, each of ring segments having an exterior profile that engages the load groove on the mandrel when the mandrel is in the lower position;

bias means for urging the ring segments radially inward;

a pair of protuberances, each carried by the mandrel for movement therewith and protruding radially therefrom, each protuberance being located between adjacent ends of the two ring segments while the mandrel is in the upper position, wherein rotating the mandrel will cause the protruberances to push radially outward on the ring segments, causing the ring segments to move out of the mandrel recess and further into the body recess to enable the mandrel to drop downward relative to the body until the profiles of the ring segments engage the load groove of the mandrel, so that an upward pull on the mandrel will transmit an upward pull through the locking element to the wellhead.

8. The well tool according to claim 5 further comprising means for selectively preventing the cam means from moving the locking member to the locked position as the mandrel moves downward relative to the body, allowing the compression member to energize the seal without the locking member being in the locked position.

9. The well tool according to claim 5 wherein:

the locking element comprises a plurality of circumferentially spaced apart dogs carried by the body; and wherein the cam means comprises a wedge ring carried by the mandrel, the wedge ring having an exterior which engages the dogs to push the dogs outward to the locked position.

10. The well tool according to claim 5 wherein:

the locking element comprises a plurality of circumferentially spaced apart dogs carried by the body and a split ring extending around an exterior side of the dogs; and wherein the cam means comprises a wedge ring carried by the mandrel, the wedge ring having an exterior which engages the dogs to push the dogs outward, which in turn push the split ring to the locked position.

11. The well tool according to claim 5 wherein:

the locking element comprises a plurality of circumferentially spaced apart dogs carried by the body; wherein the cam means comprises a wedge ring carried by the mandrel, the wedge ring having an exterior containing a plurality of axially extending slots, circumferentially spaced apart from each other, defining wedging surfaces therebetween, each of the wedging surfaces adapted to engage one of the dogs to push the dogs outward to the locked position; and further comprising:

selector means for selectively rotating the wedge ring relative to the body a selected amount to align the slots with the dogs, so that the dogs will remain in the retracted position during downward movement of the wedge ring relative to the dogs.

12. A well tool for engaging a subsea wellhead having a bore defining an inner wall having an annular groove, comprising in combination:

a mandrel adapted to be connected to a string of conduit;

a body having an axial passage which receives the mandrel, the mandrel being movable relative to the body between an upper position and a lower position;

a plurality of circumferentially spaced apart dogs carried by the body for selective radial movement between a retracted position and a locked position in locking engagement with the groove provided in the wellhead;

an annular seal carried by the body above the locking element;

a compression member mounted above the seal and carried by the mandrel for movement therewith, the compression member being movable into energizing engagement with the seal when the mandrel moves to the lower position, forcing the seal into sealing engagement with the inner wall of the wellhead;

a wedge ring carried by the mandrel, the wedge ring having an exterior containing a plurality of axially extending slots circumferentially spaced apart from each other, defining wedging surfaces therebetween;

an annular upward facing shoulder formed in the passage in the body;

an axially extending pocket located in the body and extending downward from the shoulder;

a key secured to the mandrel for movement therewith, the key landing on the shoulder while the mandrel is in the upper position, thereby supporting the mandrel in the upper position, and wherein rotating the mandrel relative to the body will align the key with the pocket, allowing the key to drop into the pocket and allowing the mandrel to move downward to the lower position; and selector means for rotating the wedge ring relative to the body a selected amount between an engaging position in which each of the wedging surfaces engage one of the dogs to push the dogs outward to the locked position when the mandrel moves to the lower position, and to a deactivating position in which each of the slots aligns with one of the dogs, so that the dogs will remain in the retracted position during downward movement of the wedge ring relative to the dogs.

13. The well tool according to claim 12 wherein the selector means comprises:

a pair of radially extending holes provided in the wedge ring;

a hole provided in the body which will selectively align with one of the holes in the wedge ring while the wedge ring is in the engaging position and with the other of the holes while the wedge ring is rotated to the deactivating position; and pin means inserted through the hole in the body and into selectively one of the holes in the wedge ring for retaining the wedge ring selectively in the engaging position and in the deactivating position.

14. A well tool for securing to a subsea wellhead which has a bore defining an inner cylindrical wall, comprising in combination:

a mandrel adapted to be connected to a string of conduit, the mandrel having a cylindrical surface;

a body having an axial passage with a cylindrical surface which closely receives the cylindrical surface of the mandrel, the mandrel being movable relative to the body between an upper position and a lower position;

a locking element carried by the body for selective radial movement between a retracted position and a locked position in supporting engagement with the inner wall of the wellhead;

cam means carried by the mandrel for movement therewith for selectively moving the locking element from the retracted position to the locked position as the mandrel moves downward relative to the body to the lower position;

an annular body recess located within the cylindrical surface of the passage of the body;

an annular mandrel recess located on the cylindrical surface of the mandrel, the mandrel recess being aligned with the body recess when the mandrel is in the upper position and being spaced below the body recess when the mandrel is in the lower position;

a load groove formed on one of the cylindrical surfaces of the mandrel and the body;

a pair of semi-circular ring segments carried in the one of the recesses and protruding radially into the other of the recesses when the mandrel is in the upper position to selectively prevent axial movement of the mandrel relative to the body, each of the ring segments having a pair of ends, each of ring segments having a profile that engages the load groove when the mandrel is in the lower position;

bias means for urging the ring segments radially from the recess in which the ring segments are carried; and a pair of protuberances, each carried by the one of the cylindrical surfaces for movement therewith and protruding radially therefrom, each protuberance being located between adjacent ends of the two ring segments while the mandrel is in the upper position, wherein rotating the mandrel will cause the protruberances to push radially on the ring segments, causing the ring segments to move out of one of the recesses and further into the other of the recesses to enable the mandrel to drop downward relative to the body until the profiles of the ring segments engage the load groove, at which time an upward pull on the mandrel will transmit an upward pull through the locking element to the wellhead.

15. The well tool according to claim 14 wherein each of the protuberances is a ball.

16. The well tool according to claim 14 wherein the bias means comprises a split ring extending around the ring segments.

17. A well tool for securing to a subsea wellhead which has a bore defining an inner cylindrical wall, comprising in combination:

a mandrel adapted to be connected to a string of conduit;

a body having an axial passage which receives the mandrel, the mandrel being movable relative to the body between an upper position and a lower position;

a locking element carried by the body for selective radial movement between a retracted position and a locked position in supporting engagement with the inner wall of the wellhead;

cam means carried by the mandrel for movement therewith for selectively moving the locking element from the retracted position to the locked position as the mandrel moves downward relative to the body to the lower position;

an annular body recess located within the passage of the body;

an annular mandrel recess located on the exterior of the mandrel, the mandrel recess being aligned with the body recess when the mandrel is in the upper position and being spaced below the body recess when the mandrel is in the lower position;

a load groove formed on the mandrel above the mandrel recess;

a pair of semi-circular ring segments carried in the body recess and protruding radially inward into the mandrel recess when the mandrel is in the upper position to selectively prevent axial movement of the mandrel relative to the body, each of the ring segments having a pair of ends, each of ring segments having an exterior profile that engages the load groove on the mandrel when the mandrel is in the lower position;

bias means for urging the ring segments radially inward;

a pair of protuberances, each carried by the mandrel for movement therewith and protruding radially therefrom, each protuberance being located between adjacent ends of the two ring segments while the mandrel is in the upper position, wherein rotating the mandrel will cause the protruberances to push radially outward on the ring segments, causing the ring segments to move out of the mandrel recess and further into the body recess to enable the mandrel to drop downward relative to the body until the profiles of the ring segments engage the load groove of the mandrel, at which time an upward pull on the mandrel will transmit an upward pull through the locking element to the wellhead.

18. The well tool according to claim 17 wherein each of the protuberances is a ball.

19. The well tool according to claim 17 wherein the bias means comprises a split ring extending around outer surfaces of the ring segments.

* * * * *

UNITED STATES PATENT AND TRADEMARK OFFICE

CERTIFICATE OF CORRECTION

PATENT NO. : 5,163,514

DATED : 11/17/92

INVENTOR(S) : Charles E. Jennings

It is certified that error appears in the above-identified patent and that said Letters Patent is hereby corrected as shown below:

At column 3, line 46, "redially" is changed to--radially--;

At column 4, line 39, "41 when wedge ring 53 is in the lower position" is deleted;

At column 8, line 22, after "of", insert--the--;

At column 10, line 17, "the body recess and" is deleted;

At column 10, line 34, after "inward;", insert--and--;

At column 14, line 13, after "inward;", insert the word--and--.

Signed and Sealed this

Seventh Day of December, 1993

*Attest:*

*Attesting Officer*

Bruce Lehman

BRUCE LEHMAN

*Commissioner of Patents and Trademarks*